United States Patent [19]

Ochs

[11] Patent Number: 5,062,538

[45] **Date of Patent: * Nov. 5, 1991**

[54] PACKAGE WITH PRESSURE VENTING CLOSURE ACCEPTING DIFFERENT TYPES OF INSERT DISKS FOR DIFFERENT FOOD PRODUCTS

[75] Inventor: Charles S. Ochs, Lancaster, Ohio

[73] Assignee: Anchor Hocking Packaging Company, Lancaster, Ohio

[ * ] Notice: The portion of the term of this patent subsequent to Feb. 19, 2008 has been disclaimed.

[21] Appl. No.: 535,114

[22] Filed: Jun. 8, 1990

Related U.S. Application Data

[63] Continuation-in-part of Ser. No. 401,999, Sep. 1, 1989, Pat. No. 4,993,572, and a continuation-in-part of Ser. No. 402,211, Sep. 1, 1989, abandoned.

[51] Int. Cl.[5] ..... B65D 51/16

[52] U.S. Cl. ..... 215/260; 215/252; 215/276

[58] Field of Search ..... 215/260, 271, 270, 276, 215/252

[56] References Cited

U.S. PATENT DOCUMENTS

| | | | |
|---|---|---|---|
| 2,449,014 | 9/1948 | Shaffer | 215/260 |
| 3,110,409 | 11/1963 | Chaplin . | |
| 3,270,904 | 9/1966 | Foster et al. . | |
| 3,360,148 | 12/1967 | Owen . | |
| 3,373,889 | 3/1968 | Giles | 215/276 X |
| 3,607,362 | 9/1971 | Cormack, Jr. . | |
| 3,690,497 | 9/1972 | Lecinski, Jr. . | |
| 3,966,071 | 6/1976 | Northup | 215/260 |
| 3,967,746 | 7/1976 | Botkin | 215/260 |
| 4,694,970 | 9/1987 | Hayes | 215/252 |
| 4,880,127 | 11/1989 | Doi . | |
| 4,993,572 | 2/1991 | Ochs | 215/260 |

FOREIGN PATENT DOCUMENTS

| | | | |
|---|---|---|---|
| 779109 | 2/1968 | Canada | 215/276 |

*Primary Examiner*—Stephen Marcus
*Assistant Examiner*—Stephen Cronin
*Attorney, Agent, or Firm*—Wood, Herron & Evans

[57] ABSTRACT

A pressure venting package for foods has a container with both top and side seal areas, and a closure which can accept two different types of insert disks, one for packaging oxygen sensitive (meat) products and the other for packaging non-oxygen sensitive (non-meat) products. The insert disk used for meat products has a gasket of low oxygen permeability and forms a seal with both the top and side seal areas of the container; whereas the insert disk used for non-meat food products forms only a top seal.

14 Claims, 2 Drawing Sheets

PACKAGE WITH PRESSURE VENTING CLOSURE ACCEPTING DIFFERENT TYPES OF INSERT DISKS FOR DIFFERENT FOOD PRODUCTS

RELATED CASES

This application is a continuation-in-part of my co-pending application Ser. No. 401,999, filed Sept. 1, 1989, now U.S. Pat. No. 4,993,572, and of my co-pending application Ser. No. 402,211, abandoned, also filed Sept. 1, 1989.

FIELD OF THE INVENTION

This invention relates to packages having closures which are capable of venting excess pressure in the container, and more particularly to a package having a closure which can accept different types of insert disks to provide different degrees of sealing, for packaging different types of food products.

BACKGROUND OF THE INVENTION

Certain types of food products which are sterile when packaged may ferment once the containers have been opened and sterility has been lost. Such fermentation is especially rapid with fruit juices. Fermentation produces carbon dioxide gas which, if the container closure is sealed, causes gas pressure inside the container to increase, especially if there is relatively little "head space" above the level of the food product in the container. In extreme cases pressure inside the sealed container can reach a level so high as to rupture and shatter a glass container and thus present a possibility of injury. In the packaging industry, internal gas pressures in excess of about 40 psi are considered undesirably high. Excessive internal pressure in a container can also arise if a jar of food is heated in a microwave oven without first removing or at least loosening the closure.

Pressure venting closures which release internal pressures in excess of a preestablished limit are known. One widely used type of pressure venting closure is described in Lecinski U.S. Pat. No. 3,690,497. That closure is a single piece metal closure having a molded gasket around the inside edge of the top and extending downwardly on the skirt of the closure. Threads are formed in the moldable gasket material while it is held in place on the container. If internal pressure becomes excessive, the threads are stripped and the closure pops off. However, undesirably high torque is required to unscrew the closure and, once the closure has been removed, resealing it is sometimes difficult.

Composite pressure venting closures are also known, having an outer shell and an insert disk or top cover which is received in the top opening of the shell, the gasket being provided on the lower face of the insert disk. Pressure is vented by upward movement of the disk within the shell, away from the container finish. My above-identified co-pending application Ser. No. 401,999 discloses one such composite, pressure venting closure. In that closure the shell has a top lip which overhangs the edge of the insert disk, above the container. The top lip of the shell has one or more recesses areas on its undersurface, which permit excessive gas pressure to deflect the disk upwardly and locally away from the rim of the container, toward and into the recessed areas, sufficiently to release excess gas pressure past the seal. Bosses or bearing areas on the undersurface of the top lip between the recessed areas prevent the recessed areas from being blocked by over-tightening the closure.

The closure shown in my co-pending application is a so-called "top seal" closure because the seal is substantially formed by and between a gasket carried on the insert disk and the top or rim of the finish. Top seal closures are useful in packaging most food products which can generate internal pressure requiring venting.

Because the gasket of a top seal closure engages only a relatively narrow area on the container rim, the sealing area may not be wide enough to seal food products which are especially sensitive to ingress of oxygen prior to opening, and which thus require a better seal. Certain types of processed food products (for example, meat products such as veal baby food) are sensitive to much lower levels of oxygen leakage into the container than other kinds of food products. (Because most of the common highly oxygen sensitive processed food products are meat products, the term "meat products" as used herein is meant to refer to and include all the highly oxygen sensitive food products, exemplified by meats, as distinguished from less oxygen sensitive food products.)

Top seal closures permit a small but undesirable degree of migration of oxygen (air) through the region of contact of the gasket with the rim of the glass container, into the partially evacuated area over the food product. Because of this leakage, a "better" seal, i.e., one which presents a longer distance through which the oxygen must migrate to enter the evacuated space, and/or which has a gasket with lower oxygen permeability, is needed for packaging meat products.

The need for a better seal for meat products generally requires both a container with a special seal area configuration and a special closure for use with the special container. Typically such seals are significantly "longer" and also are less oxygen permeable than seals for non-meat food products. Since the width of the rim of a container is limited by practical considerations, effective seal "length" is increased by extending the seal area downwardly from the top seal area, i.e., by increasing the effective width of the seal area. The region of contact between the closure gasket and the container includes a slanting or vertical side seal portion of the container finish, as well as the generally horizontal or upwardly facing rim of the container. The effective length of such a sealing area, i.e., the seal dimension across the top and down the side, may be two or three times that of a top seal alone. The resulting seal, including both the seal area at the top and the area on the side, is referred to as a "side seal."

Apart from differences in configuration between side seals and top seals, the gasket materials usually differ. The gasket of a top seal closure is frequently what is referred to as a "flowed-in" plastisol gasket composition which is poured into a channel around the periphery of the (inverted) insert disk and sets up in place without molding. In contrast, a special, more expensive composition having low oxygen permeability is generally used for side seal closures. Moreover, this material is usually molded under applied pressure to the desired configuration, and cures relatively slowly. These factors all contribute to a slower production rate and higher cost of closures for meat products, in comparison to closures for non-meat products.

Recently the baby food packing industry has started demanding closures which are tamper indicating (as by visible separation of a band around the closure upon initial opening) as well as pressure venting. This further complicates the manufacture of suitable packages. Moreover, food distributors require the packages for their meat products to have the same outward appearance as those for non-meat food products, so as not to diffuse the packaging "image" of the particular distributor. However, the cost of the special construction required to provide a side seal for meat products is significantly higher than that required for a similar package with just a top seal, so it is quite expensive to make all the closures look like the meat closures, which are used on only a small proportion of the total.

SUMMARY OF THE INVENTION

This invention relates to a package comprising a container having a top seal area suitable for sealing non-meat products and a side seal area long enough, in combination with the top seal area, for sealing meat products, and a composite closure which can alternatively accept either an insert disk that provides a top seal pressure venting closure for use with non-meat products, or a disk that provides a side seal pressure venting closure for use with meat products. Thus, a single container and closure shell can be used for either meat or non-meat packaged food products, simply by inserting the corresponding type of insert disk. The disks used for meat and non-meat products can themselves be similar except in respect to the gaskets which they carry.

For non-meat food products, the closure is used with an insert disk that forms just a top seal, and that type of disk is expected to be used in the great majority of packages. In those instances where meat products are to be packaged, the closure shell can be fitted with a new type of insert disk, described herein, which has a longer gasket and which provides more effective sealing against oxygen leakage. This dual adapatability of the same container finish configuration and the same closure shell configuration provides substantial savings, because the same configurations of container and shell can now be used for the full line of food products which require pressure venting vacuum sealing closures. Any need for special container and/or closure shell configurations for the small proportion of oxygen sensitive products is eliminated, thus reducing mold cost, inventories, danger of mismatch, and the like. Moreover, because the container and shell can present the same outside appearance, brand identity is enhanced.

In accordance with this invention the container has a top seal area of width adequate to form an effective top seal where a side seal is not needed, i.e., for non-meat products. The top seal area is the generally horizontal top portion of the rim, and its width is such that it forms a seal with a top sealing insert disk that is adequate for non-meat food products which require pressure venting capability but which do not require special protection against oxygen leakage.

The container also presents a side seal area that extends outwardly and downwardly around the top seal area, at an unusually shallow angle. The angulation of the side seal portion of the container of this invention is shallower than that of a conventional side seal container, and is such that when the closure lifts in response to internal pressure, a larger gap is provided, for a given vertical travel, than in a conventional side seal closure. This makes it possible to provide a common closure shell which alternatively will permit either top seal venting or side seal venting.

The preferred form of closure used with the container has an annular shell or skirt that presents an overhanging lip around a top opening. The insert disk, seated and retained in the shell beneath the top lip, has a gasket for engaging and sealing the container. The disk for meat products has a gasket which extends downwardly on a peripherial flange of the disk, has low oxygen permeability, and may be molded. In contrast, the disk for non-meat food products has a flowed-in (not molded) gasket which forms only a top seal on the closure. Its gasket may extend partially onto a downwardly extending flange of the disk, but the gasket does not cover the flange sufficiently to form an effective side seal.

In the most preferred embodiment, the top lip of the closure has at least one recessed area on its undersurface, which recessed area permits excessive pressure below the disk to locally deform or lift the disk upwardly, into the recessed area, to vent the pressure. Between or adjacent the recessed area are bearing areas on the undersurface of the lip, which prevent loss of the recess area by over-torquing during tightening, which would prevent venting or would permit venting only at a higher pressure than desired.

DESCRIPTION OF THE DRAWINGS

The invention can best be further described by reference to the accompanying drawings, in which.

DETAILED DESCRIPTION

Figure 1:
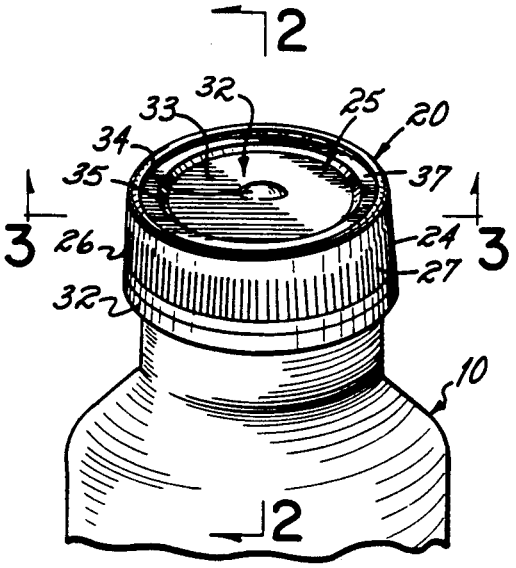
FIG. 1 is a partial perspective view of a container with a pressure venting closure in accordance with a preferred embodiment of the invention.

The container of this invention, indicated generally by 10 in FIG. 1, has a finish 11 with external threaded means 12 which may be either continuous threads or discontinuous threaded lugs for securing the closure. The container has a top opening 13 which is surrounded by a rim having a generally flat upwardly facing top sealing area 14. Area 14 will form a top seal with the insert disk of a pressure venting closure, described in more detail hereinafter.

Figure 2:
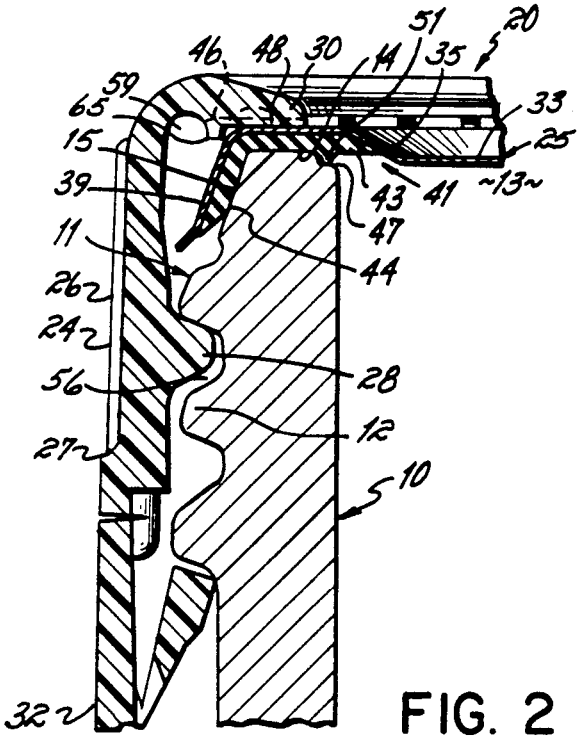
FIG. 2 is an enlarged, partial axial section taken on line 2—2 of FIG. 1, through a bearing area of the closure, and shows an insert disk of the side sealing type in sealing (non-venting) attitude on the container.
Figure 4:
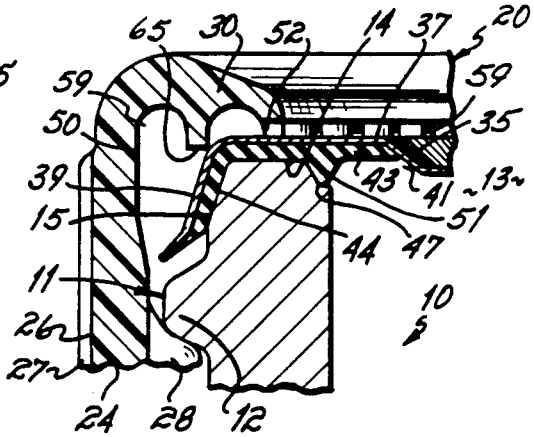
FIG. 4 is an enlarged vertical section similar to FIG. 2 but is taken on line 4—4 of FIG. 3 through a recessed area of the closure.
Figure 5:
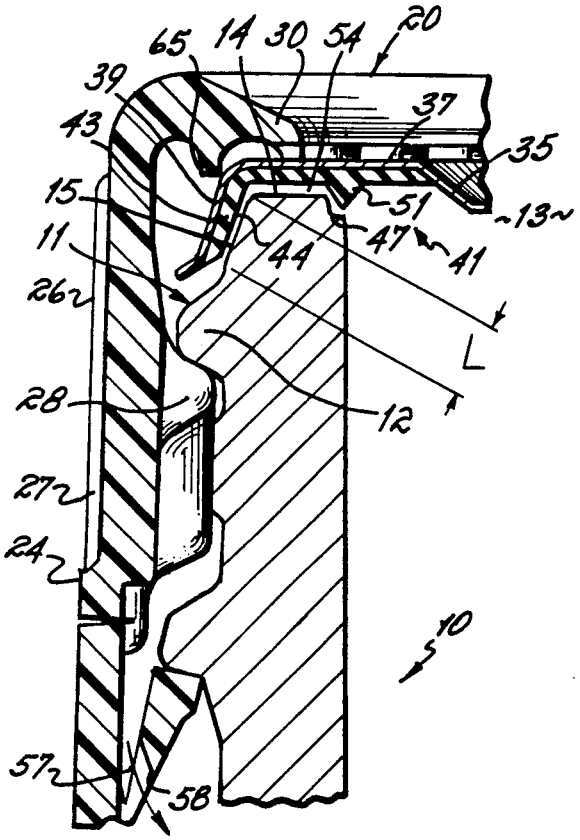
FIG. 5 is a section similar to FIG. 4 but shows the relative positions while venting gas pressure.

An angulated side seal area 15 of the finish extends around and downwardly from top seal area 14, as shown in FIGS. 2, 4, and 5. The "length" of this area 15, i.e., its dimension L in FIG. 5, is sufficient, in combination with that of the top seal area 14, that when engaged by the side seal gasket to be described, an effective side seal for packaged meat products is formed.

Container 10 receives a composite closure 20 which comprises an outer annular shell 24 and a cover or insert disk 25. Shell 24 is molded of plastic whereas disk 25 may be metal. Shell 24 includes a skirt 26 which may have external gripping means such as ribs 27, and which has internal threads or lugs 28 that are engageable with the threaded means 12 of the container. A top lip 30 projects inwardly from skirt 26 at least partially over the top sealing area 14 of the container. Shell 24 may optionally be provided with tamper indicating means as designated generally at 32. A preferred form of tamper indicating means 32 is described in the co-pending application of Thomas H. Hayes, Ser. No. 401,966 U.S. Pat. No. 4,993,572 titled "Tamper Indicating Closure Having Retaining Hoop With Relief Windows", filed Sept. 1, 1989, to which reference may be had.

Figure 6:
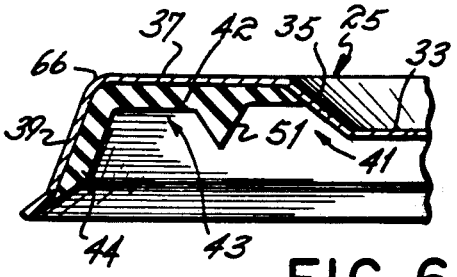
FIG. 6 is an enlarged partial section of an insert disk having a molded side seal gasket, for use in packing meat food products.
Figure 7:
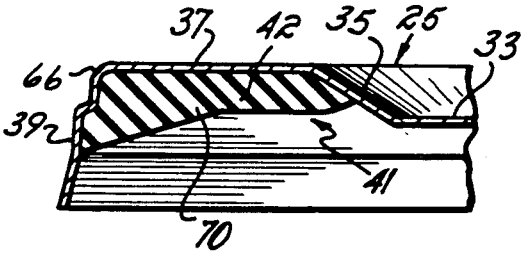
FIG. 7 is a section similar to FIG. 6, but shows an insert disk having a top sealing gasket for use in packing non-meat products.

Insert disk 25 has a lowered or drop center portion 33 which may, but need not, include a vacuum button 34 at its center (see FIG. 1). An upwardly sloping ramp 35 extends outwardly to an annulus or band 37 which in use overlies the top sealing area 14 of the container. An outer peripheral flange 39 extends downward from band 37. The flange 39 may be slanted as shown in FIG. 6, or nearly vertical as shown in FIG. 7 (the steeper the flange, the less the tendency for individual disks to overlap and interfere with one another during manufacture). Taken together, ramp portion 35, annular band 37 and downwardly angulated outer flange 39 of disk 25 define a downwardly opening channel 41 in which a sealing gasket is contained. The same configuration of insert disk 25 can be used for both meat and non-meat products, but with different shapes and types of gaskets in channel 41. The gasket 43 shown in FIGS. 2 and 4–6 is a side seal gasket and is intended for use with meat products. The gasket 70 shown in FIG. 7 is a top seal gasket and is intended for use with non-meat products.

Gasket 43 is of a low oxygen permeable sealing material which may be of known composition, see for example Cormack U.S. Pat. No. 3,607,362. The gasket has a top seal region 42 adherent to the undersurface of band 37, and a side seal region 44 adherent to the inside surface of flange 39. A circular depending rib 51 of the gasket preferably aligns and seats on an inside shoulder 47 on top seal area 14 of the container (see FIGS. 5 and 6).

Figure 3:
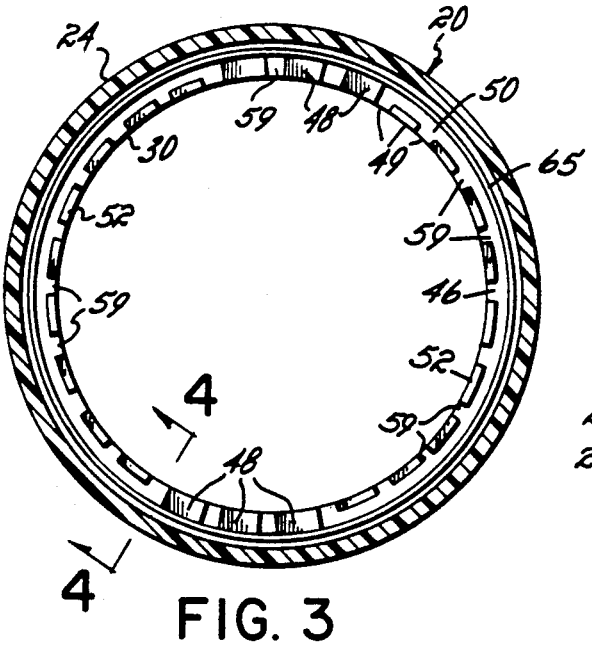
FIG. 3 is a horizontal cross section taken on line 3—3 of FIG. 1.

As best shown in FIGS. 3 and 4, the undersurface 46 of top lip 30 of closure shell 24 preferably includes at least one bearing area, boss or stop 48, six such areas being shown in FIG. 3 in groups of three on diametrically opposite sides of the lip. These bearing areas are the lowermost portions of the top lip and engage annular band 37 of disk 25, at least when the closure is being secured on container 10. (Normally the pressure differential, rather than the bearing area, holds the disk on the finish; the bearing area may not actually bear on the disk so long as the vacuum condition exists below the disk.) The bearing areas 48 preferably extend inwardly to the inner edge 49 of top lip 30, in angularly narrow regions, e.g., about 10° in the embodiment shown. When possible it is preferred that the bearing areas overlie the line of contact between the threads 12, 28. The lip 30 need not extend over the entire width of top seal area 14, but preferably it should extend to approximately the midline of the top seal area, as shown. The size and position of the bearing areas, together with cap diameter, closure composition and thickness, determine the venting pressure. In general, use of smaller bearing areas, a softer plastic, and/or a thinner lip all reduce venting pressure for a given container. In many cases the total area of the bearing areas 48 can be a small fraction of the total area of the underside of the top lip, for example less than about 20%. The underside of lip 30 may also have a depending annular lip 65, just outwardly of the upper corner 66 of the insert disk 25, but this lip does not exert hold down force on the disk, and may engage the disk only around the circumference of the disk.

Between the bearing areas 48 on the undersurface 46 of lip 30 are recessed (relatively raised) areas 50 which do not normally engage or bear on the disk 25. In the embodiment shown, the recessed areas 50 are in the form of an interrupted channel in the undersurface of the top lip, the channel being interrupted by the bearing areas 48. By way of example, the recess may be of the order of 0.007" depth, in relation to the bearing areas.

It is preferred, but not absolutely required, to provide a notched rib or flap 52 inwardly of recessed area 50, along the inner edge 49 of the top lip. This rib 52 may be flexible; its purpose is not necessarily to act as a stop or boss, as part of the bearing area, but rather as a flap to prevent dirt or other particulate matter on the disk from entering the recess 50.

Recess 50 under lip 30 permits pressure in container 10 beneath disk 25, in excess of a predetermined amount, to lift or resiliently deflect a region of disk 25 upwardly toward and into the recess area, as shown in FIG. 5. This deflection temporarily forms a vent space 54 below gasket 43, through which excess gas pressure is released outwardly past the gasket, through the side seal area and into the interthread space 56 (FIG. 2). From that space the gas is vented through an outlet 57 which may be a window 58 in the band retainer of a tamper evidencing band.

The localized upward deflection of disk 25 which creates the vent space 54 above top sealing area 14 of the container, also opens a space between the side seal area 15 and the side seal portion 44 of gasket 43. Because of the angulation of flange 39 and side seal area 44, this gap, as measured perpendicularly to side seal surface 15, is substantially less that that above the top seal. For example, 0.002 to 0.004" of vertical lift may provide only a 0.001 to 0.002" gap at the side seal.

The adequacy of the vent gap 54 is determined by its length, height, and cross sectional area. The greater the length, the more vent gap height is needed to release a given pressure in a given container. The relatively steep angulation of side seals of previous venting closures (as in the Lecinski patent previously identified) required a much larger vertical venting movement of the disk from the finish. In accordance with this invention, side seal surface 15 has a relatively shallow angulation, preferably of about 5° to 30° to vertical (i.e., to the closure axis). As a result of this shallower angle, a smaller venting movement is required, permitting use of this seal with a composite two-piece cap.

Shell top lip 30 tends to be somewhat flexible by reason of its cantilever projection inward from shell 24. If such flexing occurs, as for example in response to overtightening the closure on the container, the bearing areas prevent the disk edge from moving into the recess 50 so far as to effectively block or close the recess and thereby preclude venting in response to excess pressure. I have found that the provision of the bearing areas 48 maintains a small but very effective spacing along the recess, so that the recess cannot be filled (closed) when the closure is being tightened on the container.

If, by reason of fermenting or microwaving or other cause, internal gas pressure in the container increases when the closure is sealed (or resealed), the pressure acts upwardly on the disk, and, if in excess of a predetermined desired limiting value, for example 40 psi, it deflects the disk upwardly toward and partly into the recess 50, even though the disk is confined and held down by the bearing areas 48. This action is shown in FIG. 5. Tests have shown that a closure having a bearing area 48 in accordance with the invention can be made which will vent pressure at 20–40 psi, whereas a closure otherwise identical but without such a bearing area can be overtightened so as not to release pressures even as high as 80 to 100 psi.

As noted above, many and indeed most package food products which require pressure venting closures do not require such a long seal and admit of just a top seal. For use with such non-meat products, an insert disk which forms only a top seal can be used. Such a disk is shown in FIG. 7. The disk is simply inserted in the closure shell 24 in place of the disk used for meat products. Indeed, the metal disk itself may (but need not) be the same shape and configuration as that used for meat products, but it carries a flowed-in (non-molded) gasket 70 rather than a molded gasket. The non-meat gasket forms a top seal with top seal area 14 of the container, and need not be of especially low oxygen permeability. As shown in FIG. 7, gasket 70 does not extend so far down flange 39 (compare FIG. 6) and does not form an effective side seal, although the gasket may in fact slightly lap over the rounded rim of the container.

Thus a given container and a given closure can be used for either meat or non-meat products, simply by loading into the shell a disk with a side sealing gasket, or a disk with a top sealing gasket. The external appearance is the same in either case so that the same brand image is maintained, but the cost is significantly reduced for non-meat products because the closure need not be designed to meet the more stringent requirements for sealing meat products.

Pressure venting closures in accordance with this invention can include provision for water washing of the interthread region. Such closures are specifically described in my co-pending commonly owned application Ser. No. 402,211, titled "Container Closure With Internal Channels For Water Washing", filed Sept. 1, 1989, to which reference may be made. In FIG. 3, water slots are provided by the notches 59 in rib 52, which lead into channel 50 and open into the interthread space 56. Such slots are further described in that application.

Having described the invention, what is claimed is:

1. A package comprising a container and a pressure venting, side sealing closure, said container having a finish with an opening and a top seal area around said opening, said top seal area comprising an upwardly facing annular area at the top of the finish, said container also having a side seal area comprising an annular area extending downwardly and outwardly around said top seal area, said side seal area and said top seal area together having a width adequate for sealing meat products, said container having external thread means for securing said closure;

said closure comprising, an annular shell having a top opening and a skirt with internal thread means for engaging the thread means of said container, said closure having a top lip which projects inwardly around said top opening, an insert disk contained in said shell beneath said top lip, said insert disk having a downwardly opening gasket channel with an annular band at the top and a downwardly and outwardly angulated side seal flange around said band, a gasket in said gasket channel, said gasket covering both said band and said flange and forming a seal with both said top seal area and said side seal area of said container, said top lip of said closure having an undersurface with at least one bearing area for engaging said band above said gasket channel, the said undersurface of said top lip also having at least one recessed area which does not bear on said disk, said recessed area permitting gas pressure in said container in excess of a predetermined limit to deflect the disk upwardly into said recessed area and away from said top seal area of said container sufficiently to release excess gas pressure.

2. The package of claim 1 wherein said container has a central axis and said side seal area of said container extends downwardly at an angle of about 5° to 30° to the said axis of said container.

3. A package comprising a container and a pressure venting, side sealing closure, said container having a finish with an opening and a top seal area round said opening, said top seal area comprising an upwardly facing annular area at the top of the finish, said container also having a side seal area comprising an annular area extending downwardly and outwardly from said top seal area, said side seal area and said top seal area together having a width adequate for sealing highly oxygen-sensitive food products, said container having external thread means for securing said closure;

said closure comprising, an annular shell having a top opening and a skirt with internal thread means for engaging the thread means of said container, said closure having a top lip which projects inwardly around said top opening, a first type of insert disk contained in said shell beneath said top lip, said insert disk having a downwardly opening gasket channel having an annular band at the top and a downwardly and outwardly angulated side seal flange around said band, a gasket in said gasket channel, said gasket covering both said band and said flange and forming a seal with both said top seal area and said side seal area of said container, said closure adapted to alternatively receive a second type of insert disk, said second type of disk having a flowed-in gasket, the top seal area of said container being sufficiently wide that it will form a top seal with said second type of insert disk which top seal is effective for sealing relatively oxygen insensitive food products.

4. The package of claim 3 wherein said container has a central axis and said side seal area of said container extends downwardly at an angle of about 5° to 30° to the said axis of said container.

5. The package of claim 3 further wherein said top lip of said closure has an undersurface with at least one bearing area for engaging said first type of disk above said gasket channel, the said undersurface of said top lip also having at least one recessed area which does not bear on said first type of disk, said recessed area permitting gas pressure in said container in excess of a predetermined limit to deflect the disk upwardly into said recessed area and away from said top seal area of said container sufficiently to release excess gas pressure.

6. The package of claim 5 wherein said bearing area is positioned directly above said top seal area of said container.

7. The package of claim 5 wherein said bearing area extends across the width of said top lip.

8. The package of claim 5 wherein said bearing area is sized to bear on said first type of disk over less than about 20% of the area of the undersurface of said top lip.

9. The package of claim 5 wherein said recessed area is a channel which extends annularly around the undersurface of said top lip, said bearing area interrupting said channel.

10. The package of claim 5 further including an interthread space around said external thread means and between said skirt and said container, excess gas pressure being released past said gasket into said interthread space when said pressure deflects said disk into said recessed area.

11. The package of claim 3 wherein said second type of insert disk is the same as said first type, except for its said gasket.

12. The package of claim 3 wherein said gasket of said first type of disk is of a composition having a low oxygen permeability, and the gasket of said second type of disk is not.

13. The package of claim 3 wherein said top lip further includes a depending annular rib around said top lip, said rib engaging said disk.

14. The package of claim 13 wherein said rib is along an inner edge of said top lip.

* * * * *